US005165683A

United States Patent [19]

Beutler et al.

[11] Patent Number: 5,165,683

[45] Date of Patent: Nov. 24, 1992

[54] METHOD AND APPARATUS FOR SPORT SWING TRAINING

[75] Inventors: Gary J. Beutler, Sacramento County; James E. Schiller, El Dorado County, both of Calif.

[73] Assignee: Industrial Design & Engineering Advancements Corp., El Dorado, Calif.

[21] Appl. No.: 745,157

[22] Filed: Aug. 15, 1991

[51] Int. Cl.[5] ..... A63B 69/36; A63B 21/00

[52] U.S. Cl. ..... 273/35 R; 273/26 B; 273/193 A; 482/111; 434/252

[58] Field of Search ..... 272/116; 273/26 R, 26 B, 273/38 R, 29 A, 186 R, 186 A, 193 A, 194 B; 482/92, 111; 434/252

[56] References Cited

U.S. PATENT DOCUMENTS

| | | | |
|---|---|---|---|
| 3,424,133 | 1/1969 | Brady | 272/116 X |
| 3,809,397 | 5/1974 | Gruenewald | 273/26 B |
| 4,330,121 | 5/1982 | McCafferty | 273/26 B |
| 4,603,854 | 8/1986 | Krausz | 272/116 |
| 4,627,613 | 12/1986 | Solloway | 272/116 |
| 4,907,800 | 3/1990 | Passamaneck et al. | 273/26 B |
| 5,002,275 | 3/1991 | Beutler et al. | 272/116 X |

*Primary Examiner*—Robert Bahr

*Attorney, Agent, or Firm*—Flehr, Hohbach, Test, Albritton & Herbert

[57] ABSTRACT

A means swing training method and apparatus means for perfecting the awareness, dependent swing motion and muscle groups contributing to the performance of players who engage in dependent sport games and activities are disclosed. A blade having sufficient width and rigidity to generate air resistance during a representative swing motion is designed to fold during the upswing motion, to flatten during the downswing motion and to float on the shaft of the appendant training apparatus so as to remain perpendicular to the swing plane throughout said user downswing motion.

4 Claims, 3 Drawing Sheets

FIG. 1A
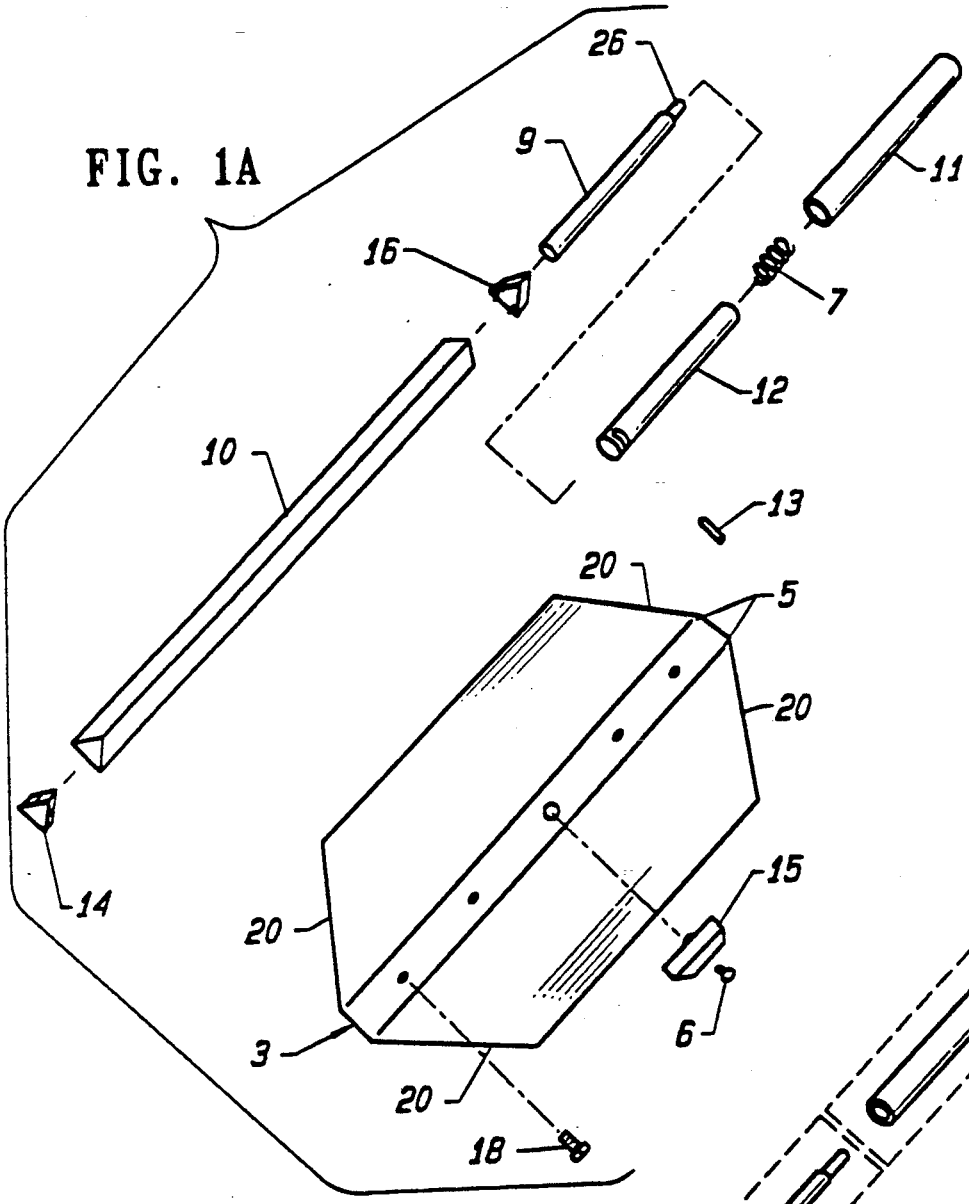
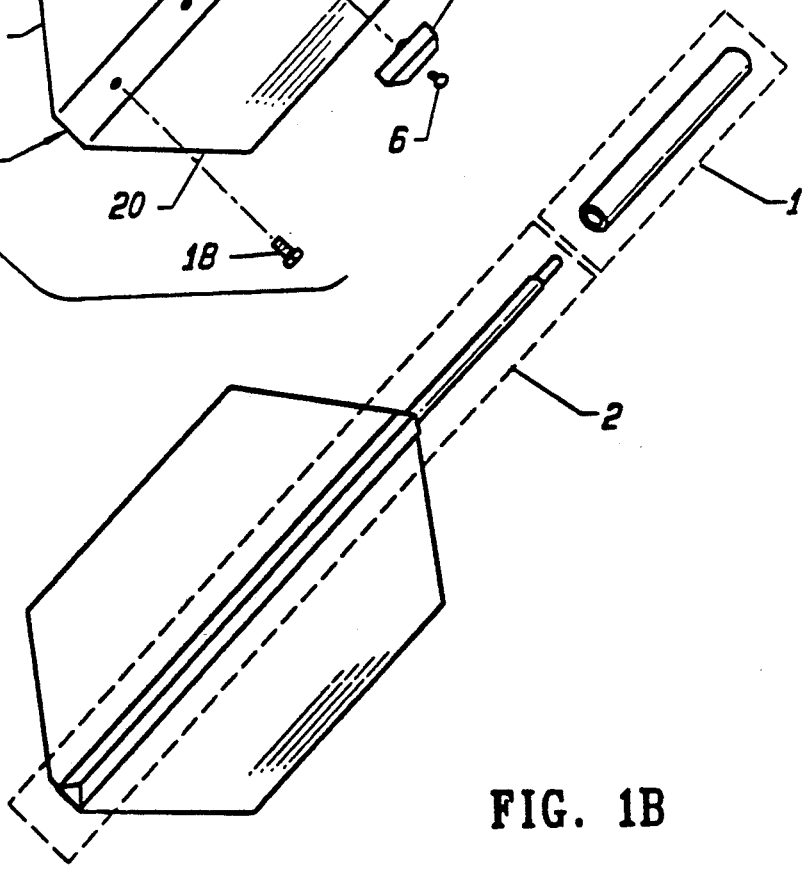
FIG. 1B

METHOD AND APPARATUS FOR SPORT SWING TRAINING

BACKGROUND OF THE INVENTION

The present invention relates to training methods and devices designed to improve the awareness, fitness and skill of users who may be engaged in related sports activity requiring swing motion.

DESCRIPTION OF THE PRIOR ART

Training devices incorporating various mechanical and electronic control means to observe and improve skills relating to player motion for sports such as golf, hockey, tennis, baseball and the like are used throughout the sports community. In particular, a variety of resistance devices have been documented that are used to improve swing motion. However, limitations of the above devices and all prior art teachings intended to improve user skills lack effective means to control the contact and/or full swing motion of the user such as to simulate actual sport activity.

Specifically, a suitable training device has not been developed or described in the prior art for controlling the resistance force imposed on the user during a representative swing motion such as to maintain the spatial plane of the user's swing action influencing ball contact and swing motion follow-through.

In the case of training devices designed to improve skills needed for sports requiring swing motion control, no training devices have been developed or suggested in the prior art that allow the user to counteract wrist or arm motion developed during the swing, such as to prevent a change in the resistance of said device during said swing motion. Known resistance devices do not aid in maintaining the ideal plane of said swing motion for repeatability and development of user skills. Prior art devices cause changes in the alignment of the swing relative to the follow-through plane, and tend to carry the simulated stick, racket or bat motion beyond the ideal swing plane, compromising the benefits and repeatability of the training exercise.

All of the training devices developed to date incorporate simple mechanical action means (friction, weights, rubber bands, etc.) to establish resistance to the swing motion of said devices during exercises designed to observe and to improve user skills. The use of air resistance is a known cost-effective means to generate said swing resistance.

However, none of the known methods provide for or suggest means for maintaining constant resistance simulating actual play throughout a given swing motion or stroke. Accordingly, continuous change in dependent resistance loading during said swing motion gives a false impression of the power and follow-through action required to control the energy and trajectory of a ball or like object that is to be influenced by said trajectory and dependent ball impact energy transfer.

Moreover, all of the prior art teachings that are used to simulate a full stroke motion use either simulation impact or actual balls to judge the potential energy transfer and technique of the user. Such methods lack the ability to simulate the follow-through resistance and motion of representative ball players. Consequently, all of the methods heretofore developed fail to address (and therefore to perfect) the required awareness and isolation of key muscle groups used to achieve overall swing-motion and dependent skill improvement.

The exercise of particular muscle groups which contribute to carry-through swing motion is extremely important to training for a particular sport. Accordingly, it is important to isolate the swing activity involved following motion along a prescribe path. While the training apparatus of the prior art as disclosed in U.S. Pat. No. 5,002,275, issued to inventors of the present invention and assigned to the same assignee, such being incorporated by reference herein, on Mar. 26, 1991, which focuses on solving the problems describe above, it does not specifically isolate only the muscles used in swinging the training apparatus along a prescribed path. Instead, it requires that other muscles groups be exercised in order for the user to position the training apparatus for descent along the prescribed path. These and related limitations of the prior art are corrected by the subject invention.

It is an object of the instant invention described herein to provide means to maintain a constant resistance force throughout a representative swing to increase player awareness of control and style influencing the results of player action.

It is a second object of this invention to provide a low-cost means for isolating certain key muscle groups for exercise and development through which the power and skill of the participant may be observed and improved for the intended sport activity.

It is still another object of this invention to provide means whereby the actual player motion during simulated game play of a sport requiring controlled swing motion may be observed and studied.

It is yet another object of the present invention to provide means to facilitate the collapse of the air resistance blade(s) during upswing positioning, and for the deployment and support of the resistance blade(s) to maintain the air resistance required throughout the prescribed path, that is, the down-swing or cross-swing motion of the user to simulate actual play.

It is also an object of the present invention to provide means to improve the stability and durability of the air resistance blade(s) incorporated in a training device for swing motion development.

It is a final object of this invention to provide means for constructing a low-cost training device whereby the skills of the user may be studied, exercised and improved without the use or need of a ball or like resistance impact.

SUMMARY OF THE INVENTION

The subject invention is a practical means for observing and exercising player swing motion to improve player skill. While suitable for a variety of sports that require controlled swing motion, the exemplary apparatus described herein is especially suited for the game of golf. This example is chosen to simplify the description of features of training apparatus that may be tailored for other specific sports activity using the disclosed teachings. For the exemplary case addressed in this specification, the device is constructed of assembled parts as would occur in low-volume manufacturing. Conversely, depending on the number of units that may be manufactured or offered at one time, molding or stamping to eliminate joining may be used to provide larger component sections that will reduce the number of parts otherwise required for assembly. The choice of technique of manufacturing is based on cost effectiveness and reliability.

The method and apparatus disclosed herein improves a golfer's swing and dependent play skill in several ways. Firstly, since the device slows down a golfer's swing (through controlled and constant air resistance) the user becomes much more aware of the basic components of the swing, i.e. the stance, grip, back swing, forward swing, and follow-through. This slowing process allows the individual to develop much greater muscle memory and a better "feel" for the swing motion and follow-through process.

Secondly, the device strengthens the necessary muscle groups that make possible a well-controlled and powerful swing. The adding of resistance throughout the swing motion acts as a substantial muscle builder.

Thirdly, the device offers a constant resistance force with very low inertia and counter forces. This is in contrast to conventional practice devices that most often employ weights or elastic cords, achieving less benefit. The most natural way to simulate a normal golf swing and still reap the benefits outlined above is by maintaining a constant resistance force throughout the user's swing and full stroke motion. A unique and critical feature of the invention described herein is the use of a floating blade and alignment means whereby the resistance acting against said user's swing motion is always constant. The device increases the required muscle power to complete a representative player stroke, thereby providing an exercise that builds key muscle groups with repetitive play action.

Fourthly, this device incorporates the feature of enabling the limiting of the exercise to particular muscle groups for a particular sport by isolating the swing activity involved following motion along a prescribe path. By providing means to facilitate the collapse of the air resistance blade(s) during upswing positioning, and for the deployment and support of the resistance blade(s) to maintain the air resistance required throughout the prescribed path, that is, the down-swing or cross-swing motion of the user to simulate actual play, the use of present invention isolates critical muscle groups.

Interdependent features of the construction and design of the device described herein differentiate the approach and total benefit(s) of this device from the capability of the devices taught in prior art.

BRIEF DESCRIPTION OF THE DRAWINGS

FIGS. 1A and 1B are assembly drawings showing the components of a device designed in accordance with the teachings of the instant invention;

DESCRIPTION OF A PREFERRED EMBODIMENT

Figure 2:
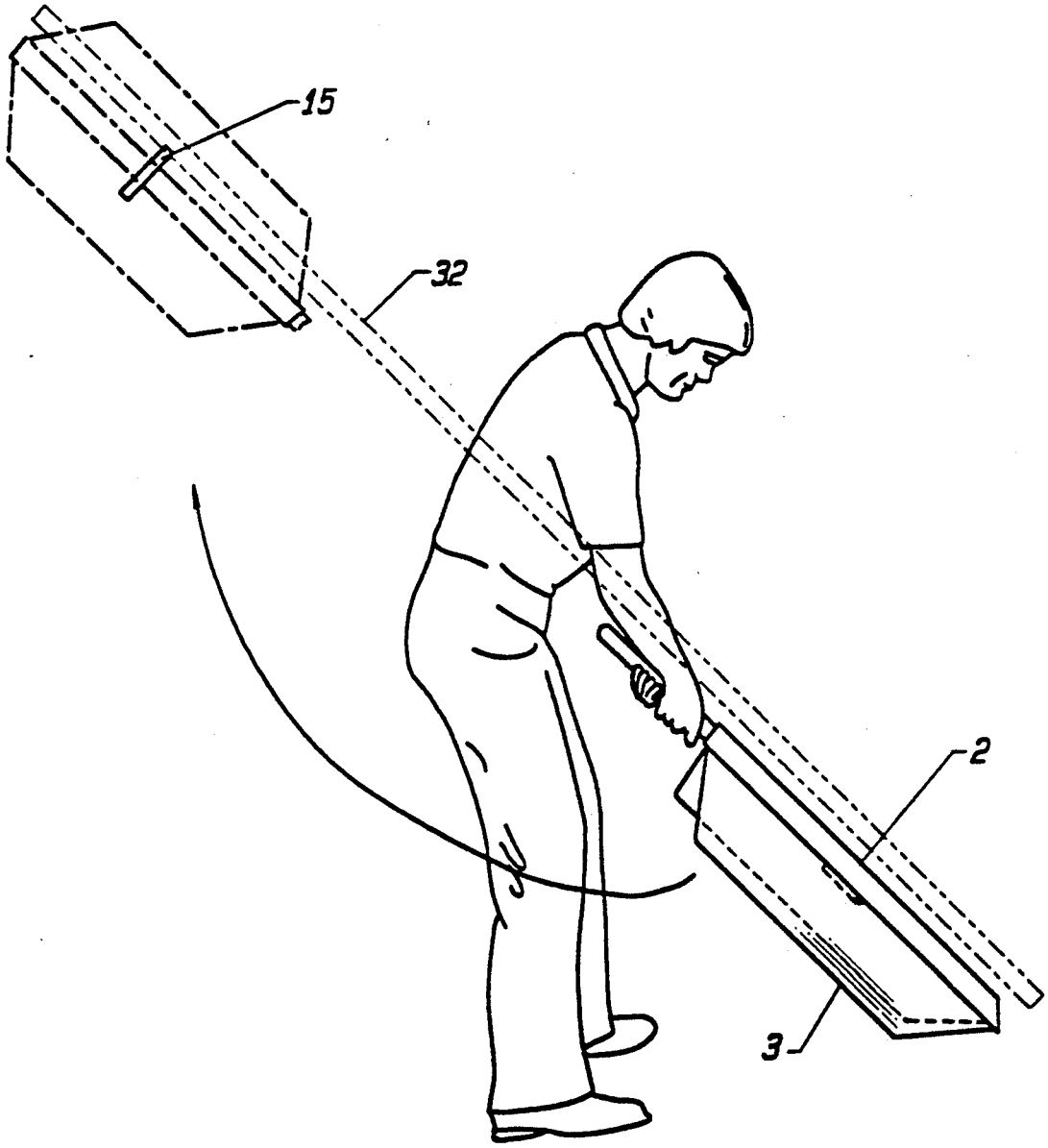
FIG. 2 is an illustration showing the resultant grip and resistance blade attitude (orientation) using a device constructed in accordance with the teachings of the instant invention.

An example of a swing training device in accordance with the present invention is illustrated in the drawings of FIG. 1. The main elements of a Swing Trainer according to the teachings of this invention are: The Grip Assembly 1, Support/Body Assembly 2, Blade 3, Hinge Point 16 and Locking Handle 15. Each of the main elements of the device may be broken down into their respective functions according to the features offered to the user.

In the case of the Golf Swing Trainer illustrated in FIG. 1A and 1B, the body of the device consists of a wooden, metal or molded plastic piece 10 upon which the foot 14, blade 3 and grip assembly 1 attach. It is constructed so as to be strong and light weight while retaining a high degree of stiffness and rigidity. The preferred embodiment illustrated (assuming low-volume manufacturing means) has predominantly triangular components for maximum strength and stiffness. The foot 14 is designed to be highly impact and wear resistant and to be replaced periodically, if necessary. This serves to protect the body of the Trainer from abrasion due to accidental impact with the ground or other surfaces.

The function of the blade 3 is to provide air resistance to the user throughout the swing motion. As shown in FIGS. 1A and 1B, the blade is shaped to offer substantial air resistance while profiling the golfer's swing and body position. In the preferred embodiment, the corners 20 of the blade 3 are angled to reduce the likelihood and influence of an impact with the ground during said swing motion, and to maintain clearance with the golfer's body.

As shown in FIG. 2, the resultant grip and resistance blade orientation using a device is constructed in accordance with the teachings of the instant invention. The figure shows the blade in the collapsed (unlocked) state for upswing positioning to the starting point of the stroke, and in the fully deployed (open) state for the decent through the downswing. The hinge closes automatically as the blade moves through the downswing due to air resistance. The advantages to hinges 16, which provide means for facilitating the collapse and open shutter behavior of the blade to simulate swing motion resistance, are numerous.

By only having the blade open during the downswing, the user is better able to focus on the powerside of the swing and less on the upswing. The present invention also allows the user to have the blade open during the upswing and the downswing by positioning locking handle 15 perpendicularly to the elongated dimension of the blade, as discussed below. Furthermore, as discussed above, by having the blades closed on the upswing and open through the downswing, there is concentrated exercise of particular muscle group. Accordingly, the present invention provides the user profiles on the dynamic characteristics of the swing.

Figure 3:
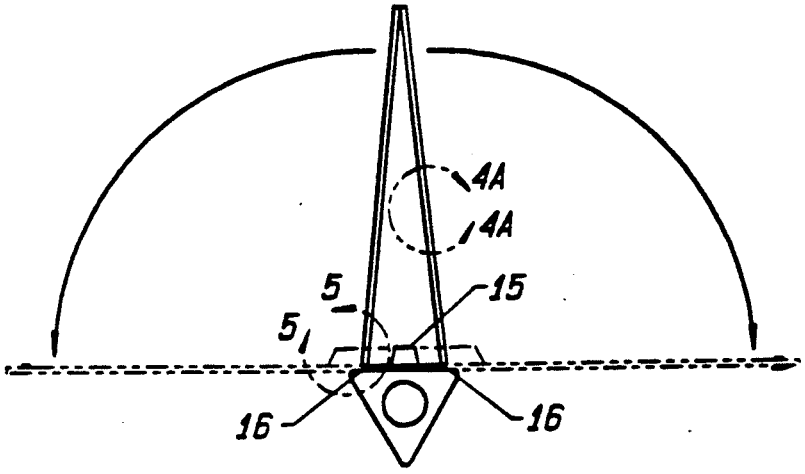
FIG. 3 is a top view of the present invention.
Figure 4A:
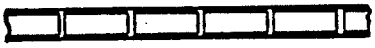
FIGS. 4A and 4B are cut away views of the material used in the preferred embodiment of the present invention.
Figure 4B:
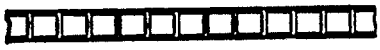
Figure 6:
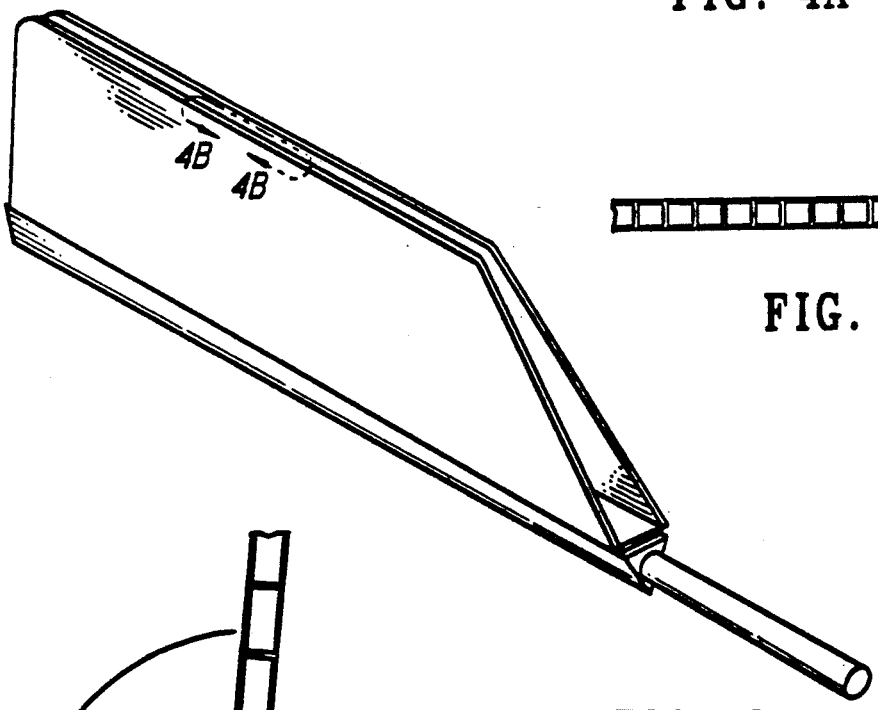
FIG. 6 is a perspective view of the present invention in its closed position.
Figure 5:
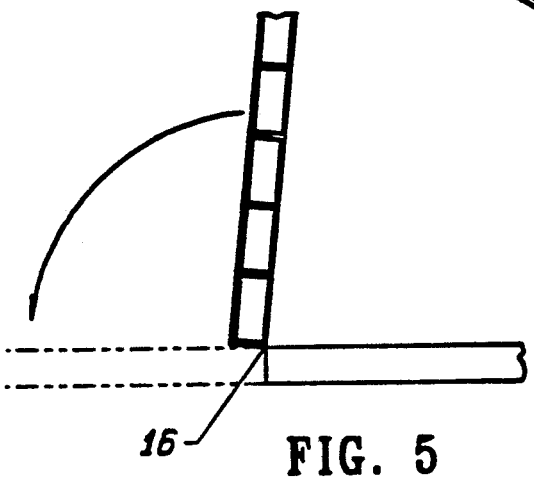
FIG. 5 is a enlarged view of the hinge point labeled number 16 in FIG. 3.

A hinge 16 in the form of fold seams 5 (see FIG. 1A) or creases are shown in the preferred embodiment illustrated in FIGS. 3, 5 and 6. In the preferred embodiment the blades are formed from profile extruded polypropylene as shown in FIGS. 4A and 4B such that incorporated into the blades' is a structure a hollow core such as honeycomb to provide needed rigidity, light weight and toughness, however any suitable material will do. In providing seams 5 by cutting through all but one layer, perpendicular to the columns of the profile extruded polypropylene, as shown in FIG. 5, hinge 16 is formed.

Hinges 16 are provided running the length of the blade to allow the blade to be folded. The folding at hinges 16 provides a dual purpose. When locking handle 15 shown in FIG. 3 in two positions, the solid lines indicating that the handle runs parallel to the elongated dimension of the blade, such positioning operates to allow the hinges 16 to open and close freely. FIG. 6 shows the blades in a fully closed position for secured storage via fasteners (not shown). When the locking handle 15 shown in FIG. 3 by dotted lines runs perpendicular to the elongated dimension of the blade so that locking handle 15 lies across both seams 5, such positioning operates to secure the blade halves in an open position and prevents the blade from folding back along the seam lines 5 and therefore not allowing the blade to open and close freely. The locking handle 15 may be attached to the body 10 at the center portion of the blade by a screw or any other any suitable means, such allowing the locking handle 15 to be turned ninety degrees into either position described above.

The present invention incorporates the spring loaded grip which is attached to the support body assembly 2. The grip includes a grip sleeve 11 which surrounds a shaft 12 which is coupled to spindle 9, the spindle 9 in turn being fastened to the support body 10 through end-cap 16. A spring 7 and fastener 18 are provided at the end of the shaft 12. The shaft 12 is fastened to the spindle 9 using pin fastener 13 which is inserted through slot 24 in the shaft 12 and then into the end 26 of spindle 9. One end of the spring 7 is fastened to the shaft 12; the opposite end of the spring is fastened to the spindle 9. By utilizing this arrangement, spring tension is imparted to the spindle from the grip. This spring tension force is asserted against the blade from the grip. As the user swings, the grip assembly 1 of the training device rotates to compensate for hand and wrist motion relative to the plane and position of the swing. The air resistance blade rotates relative to the support body assembly 2, and will remain constantly perpendicular to the swing plane, and therefore impart a constant resistance force to the passage of the blade through the air. When the swing is completed, the spring force rotates the blade back to its starting position on the shaft.

The objective is to always have the same striking angle between the golf club head and the ball and the point of contact 38 between the club head and the ball. By adopting the construction of the present invention, with the resistance blade floated on the shaft which is gripped by the golfer but is connected by a spring bias member, the blade 3 remains perpendicular to the swing plane throughout the entire stroke. This allows the user shown in FIG. 2 to rotate the grip assembly 1 of the training device during his stroke as always occurs in the case of a proper golf swing, without creating a significant change of angle outside of the perpendicular one which is achieved between the resistance blade and the plane of the swing. This invention accommodates the natural head angle change found in a normal golf swing, and simply imparts a constant resistance load which is not influenced by the typical change in head angle relative to the swing plane.

The construction illustrated in FIGS. 1A and 1B allows rotation of the blade and support body assembly during the swing motion. The spring loaded grip assembly continually exerts in the preferred embodiment a counterclockwise rotational force upon the support body assembly 2 attached to the resistance blade 3 (this counterclockwise rotational force is defined as the rotational direction seen looking down for a right-handed user; the direction of course is reversed in the case of a left-hand user).

Finally, the need for the grip assembly 1 to be spring loaded as opposed to simply being free floating is that the blade 3 must return to the home position prior to the start of each new stroke. Moreover, constant tension must be maintained on the blade throughout the swing motion. Finally, the spring biasing feature prevents the blade from spinning wildly in an uncontrolled fashion which might cause the entire unit to collide with the ground as well as nullify the benefits attributed to the constant air resistance.

The foregoing description is offered primarily for purposes of illustrating teachings that are adaptable to a variety of sports and dependent training apparatus. It will become readily apparent to those skilled in the art that variations and modifications described herein, as well as alternative expedients and components structural materials and features may be introduced without departing from the spirit and scope of the invention as defined by the claims. For example, the teachings of the device illustrated for golf swing training may also be used to improve the skills of a hockey player or baseball player in conjunction with equipment which incorporates the constant resistance training blade of the present invention. Therefore, the scope of the present invention is to be limited only by the following claims.

What is claimed is:

1. A swing training apparatus comprising:

a shaft, an air resistance blade coupled to said shaft for maintaining an appropriate level of air resistance to simulate the movement of a sport apparatus along a prescribed path having a starting point, said air resistance blade having two substantially independent half blades, folding means for folding said independent half blades into a closed position when said blade is moving along a path for positioning to said starting point of a swing motion along said prescribed path, and flattening means for flattening said independent half blades into an open position when said blade is moving along said prescribed path, and rotation means for allowing said air resistance blade to rotate around said shaft independently of said folding and flattening movement so that said blade is substantially allowed to rotate freely around said shaft within prescribed limits.

2. An apparatus as recited in claim 1 wherein said means for folding and said means for flattening is a hinge.

3. An apparatus as recited in claim 1 further comprising means for securing said open position.

4. A method for constructing a swing training apparatus comprising the steps of:

providing a shaft, coupling an air resistance blade to said shaft for maintaining an appropriate level of air resistance to simulate the movement of a sport apparatus along a prescribed path having a starting point, said air resistance blade having two substantially independent half blades, hinging said half blades in a manner to provide for their folding into a closed position and their flattening into an open position, said hinging step facilitating said closed position of said blade when said blade is moving along a path for positioning to said starting point of said swing motion along said prescribed path, and facilitating said open position of said blade when said blade is moving along said prescribed path, said coupling step including coupling said air resistance blade to said shaft so that said blade is substantially allowed to rotate freely and independently of said folding and flattening movement on said shaft within prescribed limits.

* * * * *